US006383348B2

(12) United States Patent
Kuroda et al.

(10) Patent No.: US 6,383,348 B2
(45) Date of Patent: May 7, 2002

(54) PLATING PRETREATMENT APPARATUS AND PLATING TREATMENT APPARATUS

(75) Inventors: Tetsuya Kuroda; Hidezumi Kato, both of Hamamatsu (JP)

(73) Assignee: Suzuki Motor Corporation, Shizuoka-ken (JP)

( * ) Notice: Subject to any disclaimer, the term of this patent is extended or adjusted under 35 U.S.C. 154(b) by 0 days.

(21) Appl. No.: 09/765,742

(22) Filed: Jan. 19, 2001

(30) Foreign Application Priority Data

Jan. 19, 2000 (JP) ..... 2000-009598
Jan. 19, 2000 (JP) ..... 2000-009599

(51) Int. Cl.[7] ..... C25D 17/00

(52) U.S. Cl. ..... 204/237; 204/224 R; 204/224 M; 204/272

(58) Field of Search ..... 204/224 R, 272, 204/237, 224 M

(56) References Cited

U.S. PATENT DOCUMENTS 3,956,096 A * 5/1976 Paulson et al. ..... 204/237
4,246,088 A * 1/1981 Murphy et al. ..... 204/181 R
6,086,731 A * 7/2000 Ishigami et al. ..... 204/224 R
6,183,610 B1 * 2/2001 Kataoka et al. ..... 204/272

FOREIGN PATENT DOCUMENTS

JP 8-16278 8/1988
JP 11-1795 1/1999

* cited by examiner

*Primary Examiner*—Donald R. Valentine
*Assistant Examiner*—Thomas H. Parsons
(74) *Attorney, Agent, or Firm*—Alston & Bird LLP

(57) ABSTRACT

The present invention provides a plating pretreatment apparatus that includes a cylindrical cathode disposed in a hollow portion of a fixing jig. A cylindrical object to be treated is installed on the fixing jig so that the cathode is also arranged therein. A lower portion of the cathode has a smaller diameter than an upper portion thereof. The invention also provides a plating treatment apparatus that includes an outlet jig having a hollow portion for installing a cylindrical object to be treated on a top face thereof, a cylindrical anode disposed therein so that a top end thereof projects from the top face of the outlet jig, and a plating liquid tank connected to the anode and the outlet jig. A lower portion of the anode has a smaller diameter than an upper portion thereof.

7 Claims, 3 Drawing Sheets

PLATING PRETREATMENT APPARATUS AND PLATING TREATMENT APPARATUS

BACKGROUND OF THE INVENTION

1. Field of the Invention

The present invention relates to a plating pretreatment apparatus used when plating treatment is given to the inner peripheral surface of an object to be treated formed into a cylindrical shape such as a cylinder block, and also relates to a plating treatment apparatus used when high-speed plating treatment is given to the inner peripheral surface of an object to be treated formed into a cylindrical shape such as a cylinder block.

2. Description of the Related Art

Usually, before plating is performed, plating pretreatment is done, for example, by electrolytic etching to improve the adhesion of a plating film to a base material. In the pretreatment by means of electrolytic etching, as the condition values of liquid temperature, flow rate, and electric current amount increase, the etching amount increases.

As one example of the conventional electrolytic etching, a method for plating pretreatment in which electrolytic etching is performed in a pretreatment liquid with an aluminum alloy containing silicon being used as an anode has been disclosed in Japanese Patent Provisional Publication No. 11-1795.

However, when pretreatment is given to the inside surface of a cylindrical object to be treated such as a cylinder block, the flow velocity of pretreatment liquid between the cylinder bore inside surface and a cathode is unstable, so that the flow rate, one of the above-described condition values, is nonuniform. Therefore, the etching amount varies depending on the portion to be treated. Further, for a cylinder block for a multi-cylinder engine, the liquid temperature, one of the above-described condition values, is nonuniform between cylinders, so that variations in etching amount occur. The reason for this is that even if the liquid temperature of pretreatment liquid in a pretreatment liquid tank is made constant, the voltage applied to the cylinder block increases the liquid temperature. Also, the reason is that since the outside shape differs between cylinders, a difference in liquid temperature between cylinders arises.

If plating treatment is done in this state, the plating film formed in a portion where the etching amount is small has a lower adhesion than that formed in a portion where the etching amount is large, so that variations in the adhesion of the plating film between portions also occur. Therefore, it has so far been difficult to apply plating pretreatment by means of electrolytic etching to a cylinder block.

On the other hand, usually, when electroplating is given to a cylindrical object to be treated such as a cylinder block, high-speed plating is sometimes given by increasing the current density or by decreasing an anode-cathode distance between the electrode and the object to be treated to enhance the productivity.

First, the case in which the current density is increased will be explained. For example, in the case where SiC is deposited in a form of Ni—P—SiC or Ni—SiC as the plating film, if the flow of plating liquid is nonuniform, the deposition of SiC is also nonuniform, so that a problem in regard to wear resistance of the cylinder occurs. Also, at a high current density, abnormal deposition of the plating film called "burnt deposit" may occur in a portion where the plating liquid flows slowly.

Also, if the anode-cathode distance between the electrode and the object to be treated is short, the flow of plating liquid in a gap between the object to be treated and the anode is liable to be nonuniform, so that a fault of plating film such as burnt deposit develops, and therefore good plating treatment cannot be done. Further, an anode in which soluble nickel pellets are housed in a lath-shaped titanium basket has so far been used. However, since the outer peripheral surface of the anode is formed into a wave shape, the thickness of the plating film formed on the inner peripheral surface of the object to be treated is made nonuniform by the wavy shape of the outer peripheral surface of the anode when the anode-cathode distance is as short as 1 to 5 mm. Therefore, good plating treatment cannot be done.

An adverse influence caused by nonuniform flow of plating liquid arises more easily as the anode-cathode distance, that is, the distance between the anode and the inside surface of the object to be treated is decreased. Therefore, the uniform flow of plating liquid is very important.

One prior art for providing uniform flow of plating liquid has been disclosed in Japanese Patent Publication No. 8-16278. However, this prior art is still insufficient to be used for high-speed plating, and further uniformity of plating liquid flow is demanded. When a multi-cylinder cylinder block is plated, the cylinder is required to have a construction such that it does not interfere with other cylinders.

SUMMARY OF THE INVENTION

The present invention has been made to solve the above problems, and accordingly an object thereof is to provide a plating pretreatment apparatus which can etch a cylindrical object to be treated such as a cylinder block uniformly, and can also be used for a multi-cylinder cylinder block uniformly without variations between cylinders, and a plating treatment apparatus which can cause a plating liquid to flow between an anode and an object to be treated, and can also be used for a multi-cylinder cylinder block.

To achieve the above object, the present invention provides a plating pretreatment apparatus in which a cylindrical cathode is disposed in a fixing jig in which a hollow portion is formed, and a cylindrical object to be treated is installed on the fixing jig so that the cathode is arranged in the object to be treated, wherein a lower cathode of the cathode is formed so as to have a smaller diameter than an upper cathode, whereby the volume of a lower void formed between the lower cathode and the fixing jig is made larger than that of an upper void formed between the upper cathode and the object to be treated.

According to the above-described plating pretreatment apparatus, since a plating pretreatment liquid flows at a uniform flow velocity in the object to be treated, uniform etching can be performed over the whole inside surface of the object to be treated, and adhesion of the plating film is improved, resulting in a decrease in poor adhesion.

Also, in the plating pretreatment apparatus in accordance with one mode of the present invention, the cathode is configured so as to be capable of being divided into the upper cathode and lower cathode.

Therefore, when maintenance on the cathode is performed, only the upper cathode or only the lower cathode can be replaced conveniently. Also, pretreatment can be given to a cylinder block with a different bore diameter.

Further, in the plating pretreatment apparatus in accordance with another mode of the present invention, a plurality of hollow portions of the fixing jig and cathodes are provided, and a thermometer is arranged in each cylinder.

Thereby, even in the case of a multi-cylinder engine, the temperature of the pretreatment liquid contained in each cylinder can be grasped, and by appropriately regulating the current value and the flow rate of pretreatment liquid according to the temperature, the liquid temperature can be kept constant. Therefore, there are no variations in etching amount between cylinders, and the adhesion of the plating film is improved, so that the present invention can also be applied to a multi-cylinder cylinder block.

To achieve the above object, the present invention provides a plating treatment apparatus in which a plating liquid is sent from a plating liquid tank into an anode, in which a hollow portion into which the plating liquid is sent is formed, in a state in which an electrical current is caused to flow in a cylindrical object to be treated and the anode, is discharged into the object to be treated through a top end of the anode, is caused to flow between the outside surface of the anode and the inside surface of the object to be treated, is further caused to flow between the outside surface of the anode and the inside surface of an outlet jig, and is returned to the plating liquid tank, whereby the inside surface of the object to be treated is plated, wherein the diameter of a lower anode of the anode, which is disposed in a hollow portion of the outlet jig, is made smaller than the diameter of an upper anode disposed in the object to be treated.

According to the above-described plating treatment apparatus, since an anode-cathode distance between the outside surface of the anode and the inside surface of the outlet jig is made larger than an anode-cathode distance between the outside surface of the anode and the inside surface of the object to be treated, a buffering effect is produced in the outlet jig, so that the plating liquid flows uniformly in the object to be treated. Therefore, when high-speed plating is performed, a fault of plating such as burnt deposit can be restrained, and a shortened treatment time and a reduced treatment cost can be achieved.

The above-described plating treating apparatus preferably has a construction in which the outlet jig, in which a hollow portion is formed, for installing a cylindrical object to be treated on a top face thereof, the cylindrical anode disposed so that the top end thereof projects from the top face of the outlet jig, and the plating liquid tank connected to the anode and the outlet jig through pipes are included, and the cylindrical object to be treated is installed on the top face of the outlet jig and the upper side of the anode is arranged in the object to be treated.

Also, in the plating treatment apparatus in accordance with one mode of the present invention, an insoluble anode is used as the anode.

If the insoluble anode is used, the anode-cathode distance can further be decreased, so that the plating treatment time can further be shortened. For example, when a cylinder block is used as the object to be treated, according to the present invention, the anode-cathode distance can be decreased to 1 to 5 mm, although the conventional anode-cathode distance needs to be 5 mm and larger.

Further, in the plating treatment apparatus in accordance with another mode of the present invention, the anode is configured so as to be capable of being divided into the upper anode and lower anode.

Therefore, when maintenance on the cathode is performed, only the upper cathode or only the lower cathode can be replaced conveniently.

Further, in the plating treatment apparatus in accordance with still another mode of the present invention, a plurality of hollow portions of the outlet jig and anodes are provided, whereby plating treatment can also be given to a multi-cylinder engine.

As described above, according to the plating pretreatment apparatus in accordance with the present invention, a buffering effect is produced by the lower void formed in the fixing jig, so that the plating pretreatment liquid flows uniformly in the object to be treated. Therefore, when high-speed plating is performed, a fault of plating such as burnt deposit can be restrained, and a shortened treatment time and a reduced treatment cost can be achieved.

On the other hand, according to the plating treatment apparatus in accordance with the present invention, a buffering effect is produced in the outlet jig, so that the plating liquid flows uniformly in the object to be treated. Therefore, when high-speed plating is performed, a fault of plating such as burnt deposit can be restrained, and a shortened treatment time and a reduced treatment cost can be achieved.

DETAILED DESCRIPTION OF PREFERRED EMBODIMENTS

First, a plating pretreatment apparatus in accordance with an embodiment of the present invention will be described in detail with reference to the accompanying drawing.

[Construction of Plating Pretreatment Apparatus]

Figure 1:
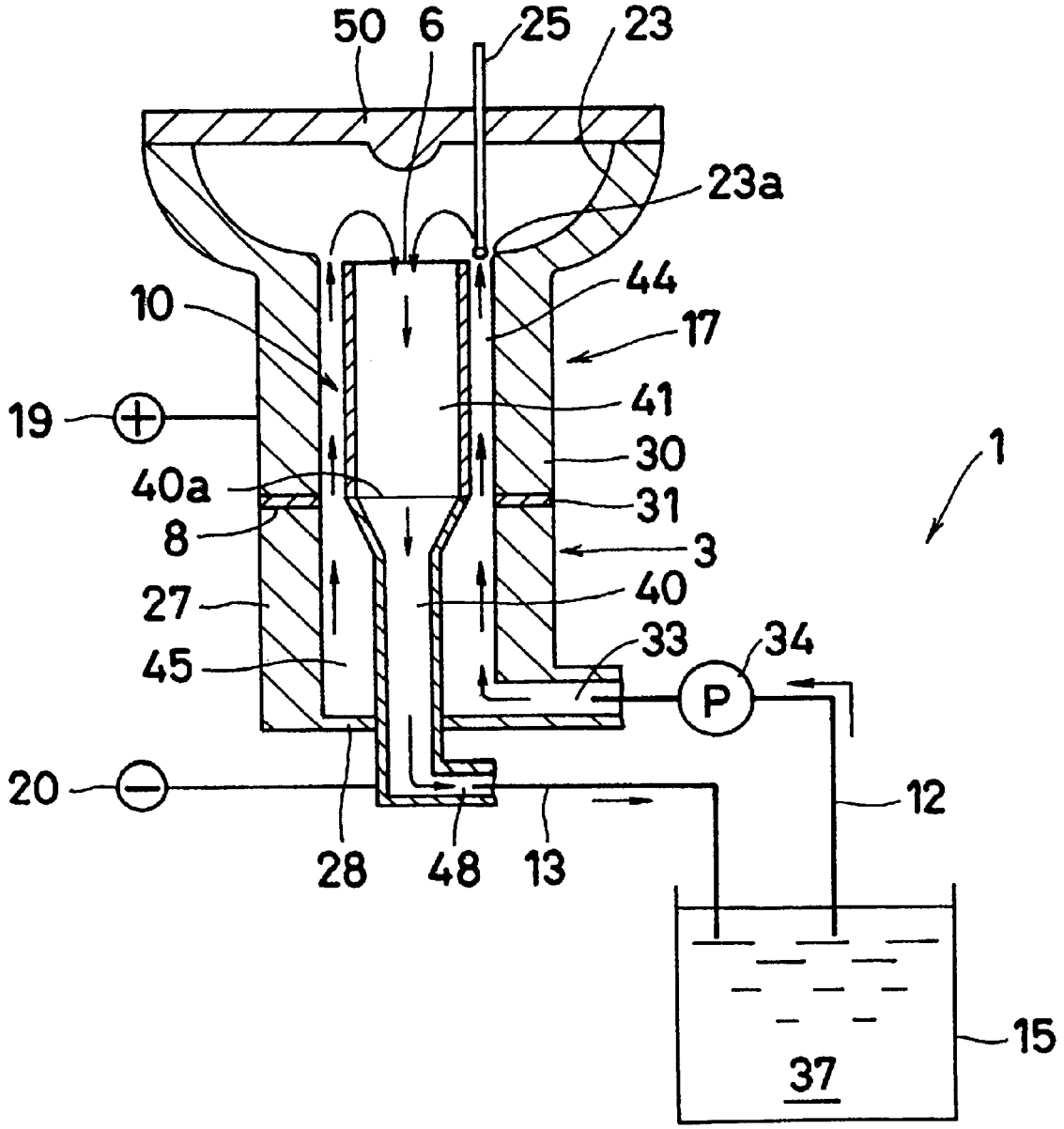
FIG. 1 is a sectional view of a plating pretreatment apparatus in accordance with the present invention.

A plating pretreatment apparatus 1 in accordance with the embodiment of the present invention includes, as shown in FIG. 1, a fixing jig 3 in which a hollow portion is formed, a cylindrical cathode 10 disposed in the fixing jig 3 so that a top end 6 thereof projects from a top face 8 of the fixing jig 3, a plating pretreatment liquid tank 15 connected to the fixing jig 3 and the cathode 10 via pipes 12 and 13, respectively, power sources 19 and 20 connected to a cylinder block 17, which is an object to be treated, and the cathode 10, respectively, and a thermometer 25 disposed in a crankcase portion 23 of the cylinder block 17.

The fixing jig 3 is surrounded by a side plate 27 formed into a cylindrical shape and a bottom plate 28, and the hollow portion is formed by the side plate 27 and the bottom plate 28. The diameter of the hollow portion is made about equal to the diameter of a hollow portion of a cylinder bore 30 of the cylinder block 17, and a sealing member 31 is disposed on the top face 8 of the side plate 27. As the sealing member 31, a material that has elasticity so as to be capable of maintaining sealing ability with respect to the cylinder block 17 is preferably used. Also, an inflow port 33 is provided at the lower part of the fixing jig 3, and the fixing jig 3 is connected to the plating pretreatment liquid tank 15 through the inflow port 33 via the pipe 12. In a halfway position of the pipe 12 is disposed a pump 34 which can deliver under pressure a pretreatment liquid 37 in the pretreatment liquid tank 15.

The cathode 10, which is formed into a cylindrical shape in which the interior is hollow, is disposed vertically so as to penetrate the hollow portions of the cylinder block 17 and the fixing jig 3. The cathode 10 is divided into two parts, upper and lower, that are constructed detachably. A top end 40*a* of a lower cathode 40 disposed on the lower side has a height about equal to the height of the top face 8 of the fixing jig 3, and the top end 6 of an upper cathode 41 disposed on the upper side is positioned at a height about equal to the height of an edge 23*a* of the crankcase portion 23 of the cylinder block 17. The diameter of the lower cathode 40 is made smaller than the diameter of the upper cathode 41. Although the diameter of the lower cathode 40 has only to be slightly smaller than that of the upper cathode 41, the dimensional difference between the diameters should preferably be, for example, 5 mm and larger. As shown in FIG. 1, at the upper part of the lower cathode 40, the diameter thereof is expanded to a diameter about equal to the diameter at the lower end of the upper cathode 41.

Therefore, an upper void 44 formed between the outer peripheral surface of the upper cathode 41 and the inside surface of the cylinder bore 30 has a smaller volume than a lower void 45 formed between the outer peripheral surface of the lower cathode 40 and the inner side surface of the fixing jig 3. At the lower end of the lower cathode 40 is provided an outflow port 48.

As described above, the pipe 12 extending from the inflow port 33 of the fixing jig 3 is connected to the plating pretreatment liquid tank 15 via the pump 34, and also the plating pretreatment liquid tank 15 is connected to the outflow port 48 of the lower cathode 40 through the pipe 13. Thereupon, the pretreatment liquid 37 is fed from the plating pretreatment liquid tank 15 to the lower void 45 of the fixing jig 3, and rises up to the upper void 44. Thereafter, the pretreatment liquid 37 flows into the upper cathode 41 through the top end 6 of the upper cathode 41, and returns to the plating pretreatment liquid tank 15 through the outflow port 48 of the lower cathode 40.

[Object to be Treated]

An object to be treated that is capable of being treated by the above-described plating pretreatment apparatus 1 is a cylindrical part in which a hollow portion is formed, such as the cylinder block 17, as shown in FIG. 1, and plating pretreatment is given to the inside surface of the hollow portion.

As shown in FIG. 1, the cylinder block 17 is installed on the plating pretreatment apparatus 1 in a vertically inverted state. That is to say, for the cylinder block 17 in a state of being mounted on a vehicle, the lower side thereof is the crankcase portion 23 whose lower part spreads outward, and the upper side is a cylinder head, the cylinder bore 30 that slidably houses a piston, not shown, being formed in the cylinder head. Therefore, when the cylinder block 17 is turned over, the upper side is the crankcase portion 23, and the lower side is a cylinder head face. The cylinder head face of the cylinder block 17 is brought into contact with the sealing member 31 disposed on the fixing jig 3, and the lower face of the crankcase portion 23 is brought into contact with a sealing member 50, whereby both of the upper and lower ends of the cylinder block 17 are sealed.

The following is a description of the flow and operation of the plating pretreatment liquid 37 in the plating pretreatment apparatus 1 having the above-described construction.

First, the pretreatment liquid 37 is sent from the plating pretreatment liquid tank 15 to the lower void 45 of the fixing jig 3 through the pipe 12 by a driving force of the pump 34. Then, the pretreatment liquid 37 rises from the lower void 45 to the upper void 44. Since the lower void 45 has a larger volume than the upper void 45, the lower void 45 plays a role of a so-called buffer. Therefore, the flow velocity of the pretreatment liquid 37 rising along the upper void 44 is uniformed, so that the whole inside surface of the cylinder bore 30 uniformly undergoes electrolytic etching. Next, the pretreatment liquid 37 overflows and flows into the upper cathode 41 through an opening formed at the top end 6 of the upper cathode 41, and then is sent to the plating pretreatment liquid tank 15 through the outflow port 48 of the lower cathode 40 via the pipe 13.

Next, a plating treatment apparatus in accordance with an embodiment of the present invention will be described in detail with reference to the accompanying drawings.

[Construction of Plating Treatment Apparatus]

Figure 2:
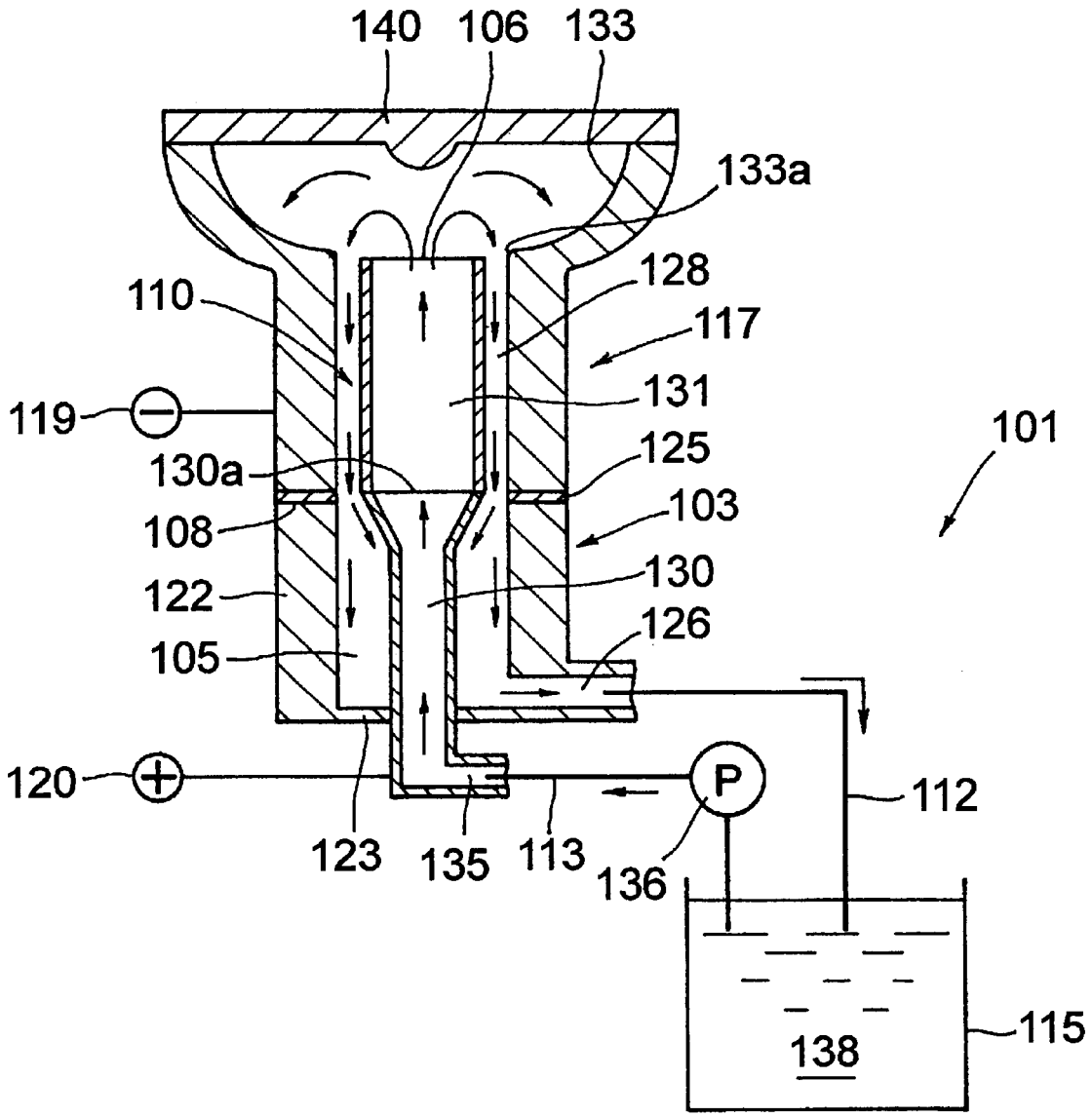
FIG. 2 is a sectional view of a plating treatment apparatus in accordance with the present invention, in which the diameter of a lower anode is smaller than that of an upper anode.

A plating treatment apparatus 101 in accordance with the embodiment of the present invention includes, as shown in FIG. 2, an outlet jig 103 in which a hollow portion 105 is formed, a cylindrical anode 110 disposed in the hollow portion 105 of the outlet jig 103 so that a top end 106 thereof projects from a top face 108 of the outlet jig 103, a plating liquid tank 115 connected to the outlet jig 103 and the anode 110 via pipes 112 and 113, respectively, and power sources 119 and 120 connected to a cylinder block 117, which is an object to be treated, and the anode 110, respectively.

The outlet jig 103 is surrounded by a side plate 122 formed into a cylindrical shape and a bottom plate 123, and a thin sealing material 125 is disposed on the top face 108 of the side plate 122. As the sealing material 125, a material that has elasticity so as to be capable of maintaining sealing ability with respect to the cylinder block 117 is preferably used. Also, a plating liquid outflow port 126 is provided at the lower part of the outlet jig 103, and the outlet jig 103 is connected to the plating liquid tank 115 through the plating liquid outflow port 126 via the pipe 112.

The anode 110, which is formed into a cylindrical shape in which the interior is hollow, is disposed vertically so as to penetrate a hollow portion 128 of the cylinder block 117 and the hollow portion 105 of the outlet jig 103. The anode 110, which is an insoluble anode, is divided into two parts, upper and lower, that are constructed detachably. A top end 130*a* of a lower anode 130 disposed on the lower side has a height about equal to the height of the top face 108 of the outlet jig 103, and the top end 106 of an upper anode 131 disposed on the upper side is positioned at a height about equal to the height of an edge 133*a* of a crankcase portion 133 of the cylinder block 117, which is an object to be treated. The diameter of the lower anode 130 is made smaller than the diameter of the upper anode 131. Although the diameter of the lower anode 130 has only to be slightly smaller than that of the upper anode 131, the dimensional difference between the diameters should preferably be, for example, 10 mm and larger. As the anode 110, for example, an anode in which the surface of a cylindrical base material composed of titanium is plated with platinum, an anode of clad material in which a thin sheet composed of platinum is bonded to a cylindrical base material composed of titanium, or an anode in which the surface of a cylindrical base material composed of titanium is coated with iridium oxide film can preferably used.

Therefore, an anode-cathode distance that is a gap (distance) between the outer peripheral surface of the upper anode 131 and the inside surface of the cylinder block 117 is made smaller than an anode-cathode distance that is a gap (distance) between the outer peripheral surface of the lower anode 130 and the inside surface of the outlet jig 103. For example, the upper anode 131 is arranged in a state of being separated from the inside surface of a cylinder bore in the cylinder block 117 with a gap of 1 to 5 mm formed therebetween and substantially in parallel with the inside surface of the cylinder bore. Further, a plating liquid outflow port 135 is provided at the lower end of the lower anode 130.

As described above, the pipe 112 extending from the plating liquid outflow port 126 of the outlet jig 103 is connected to the plating liquid tank 115, and also the plating liquid tank 115 is connected to the lower end of the lower anode 130 through the pipe 113 via a pump 136. Thereupon, a plating liquid 138 is fed from the plating liquid tank 115 to the anode 110, and after plating treatment is given to the inside surface of the cylinder block 117, the plating liquid 138 returns to the plating liquid tank 115.

[Object to be Treated]

An object to be treated that is capable of being treated by the above-described plating treatment apparatus 101 is a cylindrical part such as the cylinder block 117, as shown in FIG. 2, and plating treatment is given to the inside surface of the cylindrical part.

As shown in FIG. 2, the cylinder block 117 is installed on the plating treatment apparatus 101 in a vertically inverted state. That is to say, for the cylinder block 117 in a state of being mounted on a vehicle, the lower side thereof is the crankcase portion 133 whose lower part spreads outward, and the upper side is a cylinder head portion, the cylinder bore that slidably houses a piston, not shown, being formed in the cylinder head portion. Therefore, when the cylinder block 117 is turned over, the upper side is the crankcase portion 133, and the lower side is the cylinder head portion. A cylinder head face of the cylinder block 117 is brought into contact with the sealing material 125 disposed on the top face 108 of the outlet jig 103, and the lower face of the crankcase portion 133 is brought into contact with a sealing member 140, whereby both of the upper and lower ends of the cylinder block 117 are sealed. The above-described upper anode 131 is disposed up to a height corresponding to the inside surface of the cylinder bore.

The following is a description of the flow and operation of the plating liquid 138 in the plating treatment apparatus 101 having the above-described construction. In the present invention, high-speed plating means high-speed plating treatment conducted at a high current density of 100 ($A/dm^2$) and higher.

First, the plating liquid 138 is caused to flow from the plating liquid tank 115 to the lower anode 130 through the pipe 113 by a driving force of the pump 136. Since hollow portions are formed in the lower and upper anodes 130 and 131, the plating liquid 138 rises from the interior of the lower anode 130 to the interior of the upper anode 131, and is discharged toward the interior of the crankcase portion 133 of the cylinder block 117 through an opening provided at the top end 106 of the upper anode 131. The plating liquid 138 temporarily accumulates in the crankcase portion 133, so that the interior of the crankcase portion 133 plays a role of a so-called buffering effect. Therefore, the flow of the plating liquid 138 is uniformed. Thereafter, the plating liquid 138 flows downward between the upper anode 131 and the inside surface of the cylinder bore. As described above, the anode-cathode distance at the lower anode 130 is larger than that at the upper anode 131, so that the plating liquid 138 flows uniformly and smoothly due to the buffering effect between the lower anode 130 and the outlet jig 103 as well. A synergistic effect caused by these two buffering effects can maintain a uniform flow of the plating liquid 138 from the interior of crankcase portion to the outlet jig 103. By increasing the anode-cathode distance between the outlet jig 103 and the lower anode 130, an interference of the cylinder block 117 with other cylinders is eliminated, so that this apparatus can also be applied to a multi-cylinder engine.

EXAMPLE

Next, the present invention will further be explained by means of examples.

Example 1

After plating pretreatment was given to the inside surface of the cylinder block 17 by using the plating pretreatment apparatus 1 shown in FIG. 1, plating treatment was done by using a not illustrated plating treatment apparatus. The cathode 10 disposed in the plating pretreatment apparatus 1 is composed of the cylindrical upper cathode 41 and the lower cathode 40 having a smaller diameter than the upper cathode 41 as described above, and these upper and lower cathodes 41 and 40 can be separated from each other.

Regarding the conditions of the plating pretreatment liquid 37, the flow rate was 10 liter/minute, the concentration of phosphoric acid was 300 g/liter, and the liquid temperature was 65° C. Also, the density of current caused to flow between the cathode 10 and the cylinder block 17 was 50 $A/dm^2$. The thermometer 25 was arranged in each cylinder of the cylinder block 17. Pretreatment was given to the inside surface of the cylinder block 17 while appropriately regulating the current amount and the flow rate of pretreatment liquid so that the temperature of the pretreatment liquid 37 in each cylinder is kept constant. Then, plating treatment was done to form Ni—SiC or Ni—P—SiC plating film on the inside surface of the cylinder block 17.

Thereby, almost the same etching amount was provided for each cylinder, and variations in adhesion of the plating film between cylinders were also eliminated.

Example 2

Figure 3:
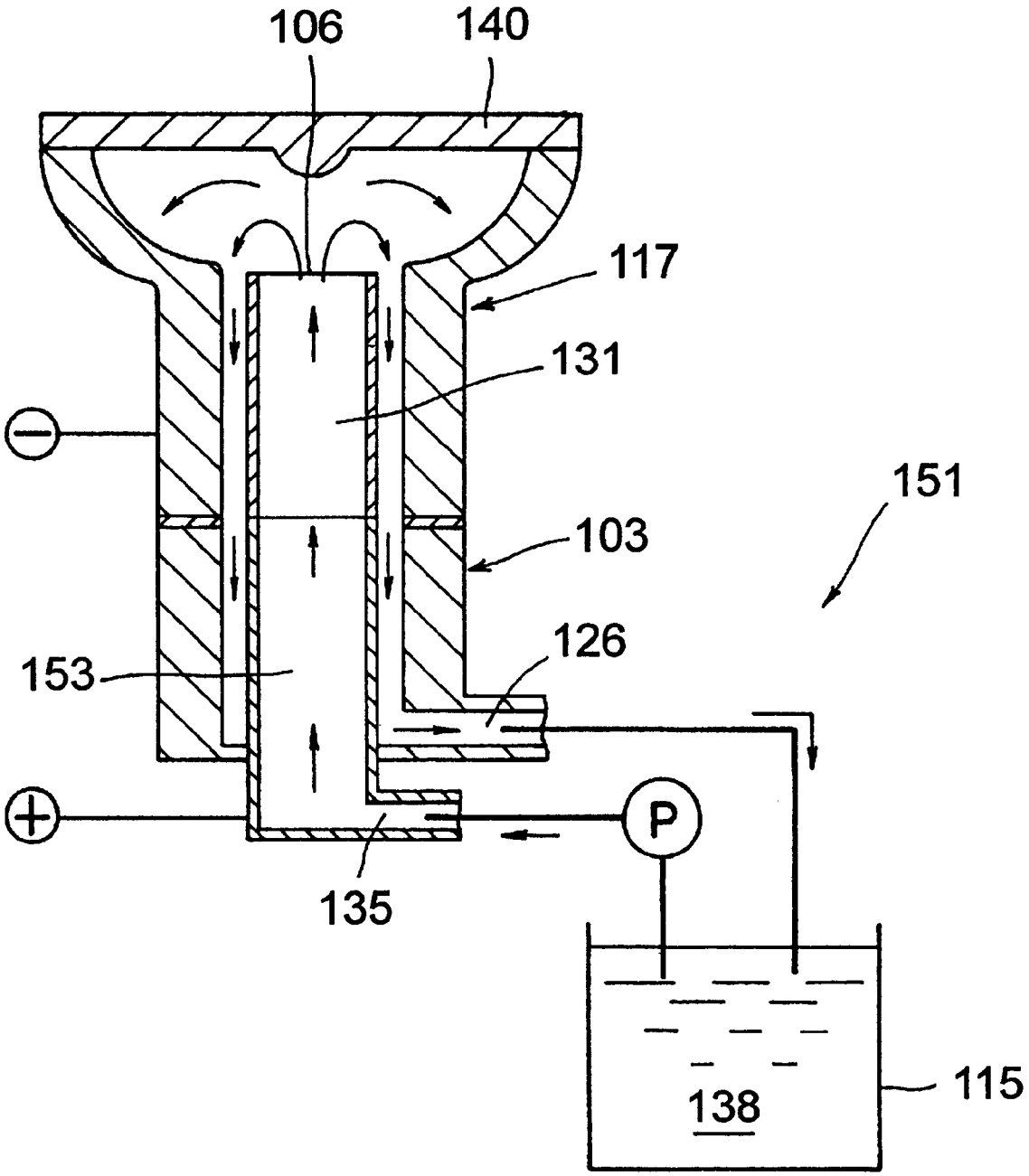
FIG. 3 is a sectional view of a plating treatment apparatus using an anode having lower and upper portions with the same diameter.

The inside surface of the cylinder block 117 was plated at various current densities by using plating treatment apparatuses 101 and 151 shown in FIGS. 2 and 3, respectively. As described above, FIG. 2 shows the plating treatment apparatus 101 having the lower anode 130 with a smaller diameter than that of the upper anode 131.

Contrarily, as a comparative example, a plating treatment apparatus 151 having a lower anode 153 with almost the same diameter as that of the upper anode 131 is shown in FIG. 3. All the construction of the plating treatment apparatus 151 shown in FIG. 3 is the same as that of the plating treatment apparatus 101 shown in FIG. 2 except for the lower anode 153.

Regarding the plating treatment conditions, the average flow velocity of the plating liquid 138 in both of the apparatuses 101 and 151 was kept constant, being 1.7 m/s, and all of the anode-cathode distance of the upper anode 131 in the apparatus 101 shown in FIG. 2 and the anode-cathode distances of the upper anode 131 and the lower anode 153 in the apparatus 151 shown in FIG. 3 were set at 5 mm. Also, three current densities of 100, 120 and 150 ($A/dm^2$) were used.

TABLE 1

| Current density ($A/dm^2$) | Present invention | Comparative example |
|---|---|---|
| 100 | ○ | ○ |
| 120 | ○ | X |
| 150 | ○ | X |

The circle mark indicates a satisfactory cylinder block without a fault of plating such as burnt deposit, and the cross mark indicates a cylinder block in which a fault of plating occurred. The term "burnt deposit" means a fault of plating such that hydrogen is produced due to a shortage of supplied Ni ions, so that the vicinity of the cathode becomes alkali, and therefore Ni(OH)x is yielded to make the portion black in color. This fault is liable to occur in a portion where the flow of the plating liquid 138 stagnates.

According to Table 1, the use of the plating treatment apparatus 1 in accordance with the present invention yielded a good result without the occurrence of burnt deposit at any current density of 100 to 150 (A/dm$^2$). The anode 110 of this type enabled high-speed plating and could restrain the occurrence of burnt deposit, whereby satisfactory plating treatment of the cylinder block 117 was made possible. Contrarily, the use of the plating treatment apparatus 151 in accordance with the comparative example brought about burnt deposit at high current densities of 120 and 150 (A/dm$^2$). This burnt deposit occurred at a portion where the flow of plating liquid 138 was nonuniform and had a low flow velocity, and also in the comparative example, since the flow of the plating liquid 138 is nonuniform, the eutectoid of SiC was also nonuniform.

According to example 2, by making the diameter of the lower anode 153 small, the plating liquid 138 flowed uniformly even at the anode-cathode distance of 1 to 5 mm. Also, the use of a flat insoluble anode such that the outer peripheral surface of the anode 110 has no irregularities such as a wavy form brought about a constant anode-cathode distance between each portion of the anode 110 and the cylinder block 117. Therefore, good plating film with uniform film thickness and without burnt deposit could be obtained.

Example 3

Next, the cylinder block 117 was plated by using the anode in the shape shown in FIG. 2 and by changing only the anode to an insoluble anode or a titanium basket. Regarding the treatment conditions of plating treatment, the average flow velocity of the plating liquid 138 in both cases was kept constant, being 1.7 m/s. The result is given in Table 2.

TABLE 2

| Current density (A/dm$^2$) | Present invention (insoluble anode) | Comparative example (titanium basket) |
|---|---|---|
| 100 | ○ | ○ |
| 120 | ○ | X |
| 150 | ○ | X |

In the case of the insoluble anode, no fault of plating such as burnt deposit occurred, and satisfactory plating treatment could be done at any current density of 100 to 150 (A/dm$^2$). However, in the case of titanium basket, a fault of plating such as burnt deposit occurred at current densities of 120 to 150 (A/dm$^2$). Also, since the outer peripheral surface of the titanium basket is formed into a wavy shape and therefore the dimensional accuracy is poor, a small anode-cathode distance may cause short-circuit between the anode and the object to be treated. Therefore, the anode-cathode distance must be larger than 5 mm.

The present invention is not limited to the above-described embodiments, and various modifications and changes can be made based on the technical concept of the present invention.

For example, although the cathode divided into upper and lower sides has been described in the pretreatment apparatus in accordance with the embodiment of the present invention, this is a case where the plating pretreatment apparatus itself is disposed vertically. In the case where the plating pretreatment apparatus is disposed obliquely or substantially horizontally, a cathode on the downstream side (corresponding to the lower cathode 40) with respect to the flow direction of pretreatment liquid in the cathode is formed integrally with a cathode on the upstream side (corresponding to the upper cathode 41) so as to have a smaller diameter than the cathode on the upstream side, whereby the effects of the present invention can be achieved.

What is claimed is:

1. A plating treatment apparatus comprising:

a fixing jig having a hollow portion formed therein, a cylindrical object to be treated installed on said fixing jig and a cathode arranged within said fixing jig and said object to be treated so as to provide a void between said cathode and each of said fixing jig and said object to be treated, wherein a lower portion of said cathode has a smaller diameter than an upper portion of said cathode so that the volume of a lower void formed between said lower cathode portion and said fixing jig is larger than the volume of an upper void formed between said upper cathode portion and said object to be treated.

2. The plating pretreatment apparatus according to claim 1, wherein said cathode is configured so as to be capable of being divided into an upper cathode and a lower cathode.

3. The plating pretreatment apparatus according to claim 1, wherein said apparatus comprises a plurality of hollow portions in said fixing jig, each having a cathode disposed therein and a cylindrical object to be treated associated therewith and a thermometer arranged in each object to be treated to allow pretreating a multi-cylinder engine.

4. A plating treatment apparatus comprising an outlet jig having a hollow portion formed therein, a cylindrical object to be treated installed on said outlet jig and an anode also having a hollow portion formed therein arranged within said outlet jig and said object to be treated so as to provide a void between said anode and each of said outlet jig and said object to be treated, wherein said apparatus is in fluid communication with a plating liquid tank to allow a plating liquid to flow from said tank into said hollow portion of the anode to allow an electrical current to flow in said cylindrical object to be treated and said anode, be discharged into said object to be treated through a top end of said anode, flow between the outside surface of said anode and the inside surface of said object to be treated, flow between the outside surface of said anode and the inside surface of an outlet jig, and be returned to said plating liquid tank, to plate the inside surface of said object to be treated, wherein the diameter of a lower portion of said anode, which is disposed in a hollow portion of said outlet jig, is smaller than the diameter of an upper portion of said anode disposed in said object to be treated.

5. The plating treatment apparatus according to claim 4, wherein said anode is an insoluble anode.

6. The plating treatment apparatus according to claim 4, wherein said anode is capable of being divided into an upper anode and a lower anode.

7. The plating treatment apparatus according to claim 4, wherein said apparatus comprises a plurality of hollow portions in said outlet jig and a plurality of anodes to allow plating treatment of a multi-cylinder engine.

* * * * *

UNITED STATES PATENT AND TRADEMARK OFFICE

CERTIFICATE OF CORRECTION

PATENT NO. : 6,383,348 B2
DATED : May 7, 2002
INVENTOR(S) : Kuroda et al.

It is certified that error appears in the above-identified patent and that said Letters Patent is hereby corrected as shown below:

Title page,
Item [73], Assignee, in the address, "Shizuoka-ken" should read -- Hamamatsu --.

Column 10,
Line 13, "treatment" should read -- pretreatment --.

Signed and Sealed this

First Day of July, 2003

JAMES E. ROGAN
*Director of the United States Patent and Trademark Office*